United States Patent [19]

Kud et al.

[11] Patent Number: 4,846,995

[45] Date of Patent: Jul. 11, 1989

[54] USE OF GRAFT POLYMERS BASED ON POLYALKYLENE OXIDES AS GRAYNESS INHIBITORS IN THE WASH AND AFTERTREATMENT OF TEXTILE MATERIAL CONTAINING SYNTHEIC FIBERS

[75] Inventors: Alexander Kud, Eppelsheim; Wolfgang Trieselt, Ludwigshafen; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 175,190

[22] Filed: Mar. 31, 1988

[30] Foreign Application Priority Data

Apr. 3, 1987 [DE] Fed. Rep. of Germany ..... 3711298

[51] Int. Cl.[4] ..... C11D 3/37; D06M 15/53

[52] U.S. Cl. ..... 252/174.21; 8/137; 252/174.23; 252/174.24; 252/DIG. 15

[58] Field of Search ..... 252/174.21, 174.23, 252/174.24, DIG. 15

[56] References Cited

U.S. PATENT DOCUMENTS

| | | | |
|---|---|---|---|
| 4,444,561 | 4/1984 | Denzinger et al. | 8/137 |
| 4,647,396 | 3/1987 | Denzinger et al. | 252/174.24 |
| 4,746,456 | 5/1988 | Kud et al. | 252/174.24 |
| 4,814,102 | 3/1989 | Baur | 252/174.24 |

FOREIGN PATENT DOCUMENTS

| | | |
|---|---|---|
| 285038 | 10/1988 | European Pat. Off. . |
| 285935 | 10/1988 | European Pat. Off. . |
| 286019 | 10/1988 | European Pat. Off. . |
| 922457 | 4/1963 | United Kingdom . |

*Primary Examiner*—A. Lionel Clingman

*Attorney, Agent, or Firm*—Joseph D. Michaels

[57] ABSTRACT

A detergent containing as grayness inhibitor in the wash and aftertreatment of textile material containing synthetic fibers graft polymers obtainable by grafting (a) a polyalkylene oxide which has a number average molecular weight of from 300 to 100,000, is based on ethylene oxide, propylene oxide and/or butylene oxide, and is end group capped at at least one end, with (b) at least on vinyl ester derived from a saturated monocarboxylic acid containing 1 to 6 carbon atoms and/or a methyl or ethyl ester of acrylic or methacrylic acid in a weight ratio (a):(b) of from 1:0.2 to 1:10.

9 Claims, No Drawings

USE OF GRAFT POLYMERS BASED ON POLYALKYLENE OXIDES AS GRAYNESS INHIBITORS IN THE WASH AND AFTERTREATMENT OF TEXTILE MATERIAL CONTAINING SYNTHEIC FIBERS

Legislation in many countries makes it necessary to substantially reduce the phosphate content in detergents or to supply phosphate-free detergents. If, however, the phosphate content in detergents is reduced, the washing action of the product suffers. Phosphates act not only as sequestrants for alkaline earth metal ions but also as incrustation and grayness inhibitors. While the problem of incrustation, ie. deposits of mineral origin on the wash, can be successfully dealt with by replacing the phosphates in detergents by other substances, this is not the case with the problem of graying, ie. the redeposition of soil particles and greases on the wash during washing. The problem of graying occurs in particular in fabrics containing synthetic fibers, in particular in polyester-containing textiles.

U.S. No. Pat. 4,444,561 discloses using copolymers which contain as characteristic monomers (a) from 50 to 90% by weight of at least one vinyl ester of a $C_1$- to $C_4$-aliphatic carboxylic acid, (b) from 5 to 35% by weight of at least one N-vinyllactam, (c) from 1 to 20% by weight of at least one monomer containing basic groups, or salts or quaternization products thereof, and (d) from 0 to 20% by weight of at least one other monomer free of carboxyl and basic groups and copolymerizable with monomers (a), (b) and (c), as copolymerized units. As grayness inhibitors in the wash and aftertreatment of textile material containing synthetic fibers.

U.S. application Ser. No. 06/914,267 discloses using graft polymers obtainable by grafting (a) polyalkylene oxides of a molecular weight (by number average) from 2,000 to 100,000 based on ethylene oxide, propylene oxide and/or butylene oxide with (b) vinyl acetate in a weight ratio of (a):(b) from 1:0.2 to 1;10 and whose acetate groups may optionally have been hydrolyzed up to 15%, as grayness inhibitors in the wash and aftertreatment of textile material containing synthetic fibers.

It is an object of the present invention to provide other grayness inhibitors for detergents and grayness inhibitors for aftertreating textile material containing synthetic fibers.

We have found that this object is achieved according to the invention by using as grayness inhibitors in the wash and aftertreatment of textile material containing synthetic fibers a graft polymer which is obtainable by grafting (a) a polyalkylene oxide which has a number average molecular weight of from 300 to 100,000, is based on ethylene oxide, propylene oxide and/or butylene oxide and is end group capped at at least one end, with (b) at least one vinyl ester derived from a saturated monocarboxylic acid containing 1 to 6 carbon atoms and/or a methyl or ethyl ester of acrylic or methacrylic acid in a weight ratio (a):(b) of from 1:0.2 to 1:10 and whose grafted-on monomer b) may optionally be hydrolyzed up to 15 mole %.

The products to be used according to the invention are known for example from GB Patent 922,457. The graft bases used are the polyalkylene oxides specified above under (a), which have a number average molecular weight of 300 to 100,000, are based on ethylene oxide, propylene oxide and/or butylene oxide and are end group capped at at least one end. Preference is given to using homopolymers of ethylene oxide or ethylene oxide copolymers having an ethylene oxide constant of from 40 to 99 mole % and being end group capped at at least one end. For the ethylene oxide polymers which are preferably used the proportion of ethylene oxide present as copolymerized units is thus from 40 to 100 mole %. Suitable comonomers for these copolymers are propylene oxide, n-butylene oxide and/or isobutylene oxide. Suitable are for example copolymers of ethylene oxide and propylene oxide, copolymers of ethylene oxide and butylene oxide, and also copolymers of ethylene oxide, propylene oxide and at least one butylene oxide. The ethylene oxide content of the copolymers is preferably from 40 to 99 mole %, the propylene oxide content from 1 to 60 mole % and the butylene oxide content in the copolymers from 1 to 30 mole %. Aside from straight-chain it is also possible to use branched homopolymers or copolymers which are end group capped at at least one end as graft base. Branched copolymers are prepared by for example addition of ethylene oxide with or without propylene oxide and/or butylene oxides onto polyhydric low molecular weight alcohols, for example trimethylolpropane, glycerol, pentoses or hexoses. The alkylene oxide unit can be randomly distributed in the polymer or be present therein as blocks. At least one terminal OH group of the polyalkylene oxides is end group capped. This is to be understood as meaning that it is for example etherified, esterified, aminated or modified by reaction with an isocyanate.

In the case of etherification, suitable substituents for the terminal H atoms of the hydroxyl groups on the polyalkylene oxides are alkyl groups having 1 to 18 carbon atoms, substituted alkyl, such as benzyl, or even phenyl. Polyalkylene oxides whose end groups are esterified are obtained for example by esterifying the abovedescribed polyalkylene oxides with carboxylic acids of 1 to 18 carbon atoms, for example by reaction with formic acid, acetic acid, propionic acid, butyric acid, malonic acid, succinic acid, stearic acid, maleic acid, terephthalic acid or phthalic acid. If carboxylic anhydrides are available, the end group cap on the polyalkylene oxides can also be obtained by reaction with the corresponding anhydrides, for example by reaction with maleic anhydride. The polyalkylene oxides can also be modified at at least one end by reaction with isocyanates, for example phenyl isocyanate, naphthyl isocyanate, methyl isocyanate, ethyl isocyanate or stearyl isocyanate.

Aminated products are obtained by autoclave reaction of the corresponding alkylene oxide with amines, for example $C_1$- to $C_{18}$-alkylamines.

Component (b) comprises vinyl esters derived from a saturated monocarboxylic acid containing 1 to 6 carbon atoms, and also methyl acrylate, ethyl acrylate, methyl methacrylate, ethyl methacrylate and mixtures thereof. Suitable vinyl esters are for example vinyl formate, vinyl acetate, vinyl propionate, vinyl butyrate, vinyl valerate, vinyl i-valerate and vinyl caproate. Of the monomers of group (b) preference is given to using vinyl acetate, vinyl propionate, methyl acrylate, methyl methacrylate and mixtures thereof. The graft copolymers are prepared in a conventional manner, for example by grafting the polyalkylene oxides of component (a) which are end group capped at at least one end, with the monomers of component (b) in the presence of free radical initiators or by the action of high-energy radiation, which includes the action of high-energy electrons. This can be done by dissolving component (a) in at least one monomer of group (b), adding a polymerization initiator and polymerizing the mixture to completion. The graft copolymerization can also be carried out semicontinuously by first introducing only a part, for example 10%, of the mixture of end group capped polyalkylene oxide to be polymerized, at least one monomer of group (b) and initiator, heating to polymerization temperature and, after the polymerization has started, adding the remainder of the mixture to be polymerized at a rate comensurate with the rate of polymerization. The graft copolymers can also be obtained by introducing the end group capped polyalkylene oxides of group (a) into a reactor, heating to the polymerization temperature and adding at least one monomer of group (b) and polymerization initiator either all at once, a little at a time or preferably uninterruptedly and polymerizing to completion. The weight ratio of components (a):(b) is from 1:0.2 to 1:10, preferably from 1:0.5 to 1:6.

Suitable polymerization initiators are in particular organic peroxides, such as diacetyl peroxide, dibenzoyl peroxide, succinyl peroxide, di-tert-butyl peroxide, tert-butyl perbenzoate, tert-butyl perpivalate, tert-butyl permaleate, cumene hydroperoxide, diisopropyl peroxodicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide and also mixtures thereof, redox initiators and azo starters.

The graft polymerization takes place at from 50° to 200° C., preferably at from 70° to 140° C. It is customarily carried out under atmospheric pressure, but can also be carried out under reduced or superatmospheric pressure. If desired, the graft copolymerization described above can also be carried out in a solvent. Suitable solvents are for example alcohols, eg. methanol, ethanol, n-propanol, isopropanol, n-butanol, sec-butanol, tert-butanol, n-hexanol and cyclohexanol, and also glycols, such as ethylene glycol, propylene glycol and butylene glycol, and also the methyl or ethyl ethers of dihydric alcohols, diethylene glycol, triethylene glycol, glycerol and dioxane. The graft polymerization can also be carried out in water as solvent. In this case, the first step is to introduce a solution which, depending on the amount of added monomers of component (b) is more or less soluble in water, and can take on a disperse character. To transfer any water-insoluble products which form during the polymerization into solution, it is possible for example to add organic solvents, for example monohydric alcohols having 1 to 3 carbon atoms, acetone or dimethylformamide. However, in the graft polymerization in water it is also possible to transfer the water-insoluble graft polymers into a finely divided dispersion by adding customary emulsifiers or protective colloids, for example polyvinyl alcohol. The emulsifiers used are for example ionic or nonionic surfactants whose HLB value is within the range from 3 to 13. For the definition of the HLB value reference is made to the paper by W.C. Griffin in J. Soc. Cosmet. Chem. 5 (1954), 249. The amount of surfactant, based on the graft polymer, is from 0.1 to 5% by weight. If water is used as the solvent, solutions or dispersions of graft polymers are obtained. If solutions of graft polymers are prepared in an organic solvent or in mixtures of an organic solvent and water, the amount of organic solvent or solvent mixture used per 100 parts by weight of the graft polymer is from 5 to 200, preferably from 10 to 100, parts by weight.

The graft polymers have a K value of from 5 to 200, preferably from 5 to 50 (determined according to H. Fikentscher in 2% strength by weight solution in dimethylformamide at 25° C.). After the graft polymerization the graft polymer may optionally be subjected to a partial hydrolysis where up to 15 mole % of the grafted-on monomers of component (b) are hydrolyzed. For instance, the hydrolysis of graft polymers prepared using vinyl acetate as preferred monomer of group (b) gives graft polymers containing vinyl alcohol units. The hydrolysis can be carried out for example by adding a base, such as sodium hydroxide solution, potassium hydroxide solution, ammonia ar amines, such as triethanolamine, morpholine or triethylamine, or alternatively by adding acids, for example HCL, and if necessary heating the mixture.

The graft polymers described above are used according to the invention in detergents of reduced phosphate content (which is to be understood as meaning a phosphate content of less than 25% by weight of sodium triphosphate) or in phosphate-free detergents. For grayness inhibition in the wash, the graft polymers described above are added to commercially available detergent formulations in an amount of from 0.1 to 5, preferably from 0.3 to 3, % by weight, based on the detergent mixture. For addition to the detergent formulation the graft polymers can be in the form of granules, in the form of a paste or of a highly viscous material, or as a dispersion or solution in a solvent. The graft polymers can also be adsorbed on the surface of additives, for example sodium sulfate, or builders (zeolites) and other solid assistants making up the detergent formulation.

Commercially available pulverulent detergents whose phosphate content is below 25% by weight and those which contain no phosphate at all contain as an essential constituent surfactants, for example $C_8$- to $C_{12}$-alkylphenol ethoxylates, $C_{12}$- to $C_{20}$-alkanol ethoxylates, and also block copolymers of ethylene oxide and propylene oxide. The polyalkylene oxides are solid substances at from room temperature to 70° C. and readily soluble or dispersible in water. The comprise in particular linear or branched reaction products of ethylene oxide with propylene oxide and/or isobutylene oxide which have a block structure or which can also have a random structure. The end groups of the polyalkylene oxides are capped or uncapped. The term capping as used herein is to be understood as meaning that the free OH groups of the polyalkylene oxides can be etherified and/or esterified and/or aminated and/or reacted with isocyanates.

Other suitable constituents of pulverulent detergents are anionic surfactants, such as Cg- to $C_{12}$-alkylbenzenesulfonates, $C_{12}$- to $C_{16}$-alkanesulfonates, $C_{12}$-to $C_{16}$-alkyl sulfates, $C_{12}$- to $C_{16}$-alkylsulfosuccinates and sulfated ethoxylated $C_{12}$- to $C_{16}$-alkanols. Pulverulent detergents customarily contain from 5 to 20% by weight of a surfactant or a mixture of surfactants. The surfactant content in liquid detergents is within the range from 15 to 50% by weight.

The pulverulent detergents may optionally also contain polycarboxylic acids or salts thereof, for example tartaric acid and citric acid.

A further important constituent of detergent formulations are incrustation inhibitors. These substances are for example homopolymers of acrylic acid, methacrylic acid and maleic acid and copolymers, for example copolymers of maleic acid and acrylic acid, copolymers of maleic acid and methacrylic acid and copolymers of a) acrylic acid and/or methacrylic acid with b) acrylic esters, methacrylic esters, vinyl esters, allyl esters, itaconic esters, itaconic acid, methylenemalonic acid, methylenemalonic esters, crotonic acid and crotonic esters. Also suitable are copolymers of olefins and $C_1$- to $C_4$-alkyl vinyl ethers. The molecular weight of the homopolymer or copolymer is from 1,000 to 100,000. The incrustation inhibitors are used in an amount of from 0.5 to 10% by weight in detergents, in which case they are used in unneutralized form as alkali metal or ammonium salt or in partially neutralized form, for example from 40 to 60% neutralization of the carboxyl groups.

Further possible constituents of detergents are corrosion inhibitors, monomeric, oligomeric and polymeric phosphonates, ether sulfonates based on unsaturated fatty alcohols, for example oleyl alcohol ethoxylate butyl ether and alkali metal salts thereof. These substances can be characterized for example with the aid of the formula $RO(CH_2CH_2O)_n—C_4H_8—SO_3Na$ where n is 5 to 40 and R is oleyl. Pulverulent detergents may also contain zeolites, for example in an amount of from 5 to 30% by weight. The detergent formulations may also contain bleaching agents. If bleaching agents are used, they are customarily employed in amounts of from 3 to 25% by weight. A suitable bleaching agent is for example sodium perborate. The detergent formulations may also contain bleach activators, softeners, antifoams, scent, optical brighteners and enzymes. Additives, for example sodium sulfate, may be present in an amount of from 10 to 30% by weight.

The graft polymers described above can also be used as additives in liquid detergents. Liquid detergents contain as admixture component liquid or even solid surfactants which are soluble or at least dispersible in the detergent formulation. Suitable surfactants for this purpose are those products which are also used in pulverulent detergents, and also liquid polyalkylene oxides or polyalkylated compounds. If the graft polymers are not directly miscible with the other constituents of the liquid detergent, a homogeneous mixture can be prepared by means of small amounts of solubilizers, for example water, or of a water-miscible organic solvent, for example isopropanol, methanol, ethanol, glycol, diethylene glycol or triethylene glycol.

The graft polymers are also suitable for use as additives in the aftertreatment of textile material containing synthetic fibers. For this purpose they are added to the final rinse bath of a washing machine cycle either together with a fabric conditioner customarily used at this juncture or, if a fabric conditioner is undesirable, alone in place of the fabric conditioner. The quantities used are from 0.01 to 0.3 g/l of wash liquor. The use of graft polymers in the final rinse bath of a washing machine cycle has the advantage that the wash in the next wash cycle is substantially less soiled by detached dirt particles present in the wash liquor than without the addition of the grayness inhibitor in the preceding wash.

In the Examples, the parts and percentages are by weight. The K values of the graft polymers were determined according to H. Fikentscher, Cellulosechemie, 13 (1932), 58–64, 71–74, in a polymer concentration of 2% strength by weight in dimethylformamide at 25° C.; K is here $k.10^3$. The Fikentscher K-value is an art recognized and accepted indication of relative molecular weights of polymers and is described in, "Vinyl and Related Polymers" by Schidlkneckt, John Wiley and Sons, New York 11, N.Y., 1952, at page 676. The number average molecular weights of the polyalkylene oxides a) used were calculated from the OH number.

The following products were used: graft polymers 1 to 21

The graft polymers were prepared using the process disclosed in GB Patent 922,457 by grafting the monomers (b) indicated in Table 1 onto 100 parts of a polyalkylene oxide having the number average molecular weight likewise indicated in Table 1. The polymers 1, 3 to 10 and 18 to 20 had been etherified, in polymers 2, 11 and 12 one terminal OH group of the polyalkylene oxide had been esterified, in polymer 15 one terminal OH group had been aminated with $C_{10}$-amine, in polymers 16 and 17 both the terminal OH groups of the polyalkylene oxide had been esterified with maleic acid, and in polymer 19 one group of the polyalkylene oxide had been etherified with a $C_{10}$-alkyl group while the other had been esterified with maleic acid.

TABLE 1

| Polymer | PAO used | Molecular weight $M_n$ | End group capped at one end | Monomer (b) | Weight ratio PAO/monomer | K value of graft copolymer |
|---|---|---|---|---|---|---|
| 1 | PEO/PPO | (90/10) 300 | C8-alkyl[1] | VAc | 1:0.5 | 10.2 |
| 2 | PEO/PPO | (90/10) 300 | MS | VAc | 1:1.5 | 12.6 |
| 3 | PEO | 3,500 | C16/C18-alkyl | VAc | 1:2.0 | 22.5 |
| 4 | PEO | 2,200 | C16/C18-alkyl | VAc | 1:1.0 | 17.9 |
| 5 | PEO | 2,200 | C16/C18-alkyl | VAc | 1:2.0 | 19.6 |
| 6 | PEO | 2,200 | C16/C18-alkyl | VAc | 1:3.0 | 22.3 |
| 7 | PEO | 2,200 | C16/C18-alkyl | VPr | 1:2.0 | 18.0 |
| 8 | PEO | 3,500 | C16/C18-alkyl | VPr | 1:3.0 | 21.6 |
| 9 | PEO | 3,500 | C13/C15-alkyl | VAc | 1:2.5 | 20.1 |
| 10 | PEO | 4,800 | C10-alkyl | MA | 1:1.5 | 29.5 |
| 11 | PEO | 4,800 | MS | MMA | 1:2.5 | 27.8 |
| 12 | PEO | 9,000 | BS | VAc | 1:2.0 | 38.6 |
| 13 | Polymer 6, but completely hydrolyzed (comparison) | | | | | 34.5 |
| 14 | Polymer 7, but completely hydrolyzed (comparison) | | | | | 32.8 |
| 15 | PEO | 528 | NH-C10-alkyl | VAc | 1:2.0 | 18.2 |
| | | | End group capped at | | | |

TABLE 1-continued

| Polymer | PAO used | Molecular weight $M_n$ | both ends with | | Monomer (b) | Weight ratio PAO/monomer | K value of graft copolymer |
|---|---|---|---|---|---|---|---|
| 16 | PEO | 3,500 | MS | MS[2] | VAc | 1:1.5 | 20.3 |
| 17 | PEO | 3,500 | MS | MS | VAc | 1:2.5 | 28.3 |
| 18 | PEO | 3,500 | C10 | C10 | VAc | 1:2.0 | 24.1 |
| 19 | PEO | 3,500 | C10 | MS | VAc | 1:2.5 | 22.8 |
| 20 | PEO | 3,500 | C16 | C16 | VAc | 1:2.0 | 26.3 |
| 21 | PEO | 3,500 | Ph—NCO | Ph—NCO | | 1:2.0 | 21.0 |

PAO = polyalkylene oxide
PEO = polyethylene oxide
PPO = polypropylene oxide
VAc = vinyl acetate
VPr = vinyl propionate
MS = maleic acid
BS = succinic acid
MA = methyl acrylate
MMA = methyl methacrylate
Ph = phenyl
Mn = number average molecular weight
[1]indicates that the polyalkylene oxide used is capped at one end with a $C_8$-alkyl group
[2]indicates that the PEO having a molecular weight of 3,500 is esterified with maleic acid at both ends; the other abbreviations have corresponding meanings.

The grayness-inhibiting action of the graft polymers indicated above was tested as follows: Polyester test fabrics and polyester/cotton blend fabrics were subjected to a series of 3 washes together with a standard soiling fabric. The soiling fabric is renewed after every wash, the test fabric becoming more soiled in every wash. The whiteness of the test fabric after the third wash is used to assess the degree of soiling. Confidence in the results is increased by multiple replication and averaging. Photometric measurement of the reflectance in % was carried out in the present case at a wavelength of 460 nm (barium primary white standard as laid down in German Standard Specification DIN 5,033) on an ELrepho 2000 (Datacolor).

| Test conditions: | |
|---|---|
| Test equipment: | Launder-O-meter |
| Water hardness: | 3.5 mmol of Ca/l, Ca:Mg = 3:2 |
| Liquor quantity: | 250 ml |
| Liquor ratio: | 10:1 |
| Test temperature: | 35 to 60° C. |
| Test duration: | 30 minutes (with heating-up time) |

Detergent concentration: 8 g/l

In the Examples, the grayness inhibitor was always used in an amount of 0.5%, based on the test detergent. The test vessels each contain 15 g of test fabric (5 g of polyester, 5 g of polyester/cotton blend and 5 g of cotton fabric) and 10 g of soiling fabric. The soiling fabric used was cotton soiling fabric from the Krefeld laundry research station, specifically WFK 100.

The test detergent used had the following composition:

| | |
|---|---|
| $C_{12}$-alkyl benzenesulfonate | 6.25% |
| Tallow fat alcohol reacted with 11 ethylene oxide | 4.7% |
| Soap | 2.8% |
| Na triphosphate (90% retention) | 20% |
| Na perborate (tetrahydrate) | 20% |
| $Na_2SO_4$ | 24% |
| Sodium disilicate | 6% |
| Mg silicate | 1.25% |

-continued

| | |
|---|---|
| Carboxymethylcellulose (CMC), Na salt | 0.6% |
| Tetrasodium salt of ethylenediamine-acetic acid | 0.2% |
| Remainder water ad | 100%. |

The test detergent is thus a phosphate-reduced detergent of the type commercially available since the second stage of the provisions of the West German Detergents Act concerning the maximum quantity of phosphate came into force in January 1984.

Table 2 shows the increase in the reflectance of polyester and polyester/cotton blend fabrics after addition of 0.5% of the products to be used according to the invention, based on weight of test detergent used. Table 2 also shows the results of comparative examples.

TABLE 2

| | Addition 0.5% based on test detergent | % reflectance PES | % reflectance PES/Co |
|---|---|---|---|
| Example No. | | | |
| 1 | Polymer 1 | 57.3 | 63.6 |
| 2 | Polymer 2 | 56.8 | 62.7 |
| 3 | Polymer 3 | 62.7 | 62.4 |
| 4 | Polymer 4 | 62.3 | 64.9 |
| 5 | Polymer 5 | 59.3 | 62.3 |
| 6 | Polymer 6 | 57.3 | 62.9 |
| 7 | Polymer 7 | 58.5 | 62.7 |
| 8 | Polymer 8 | 64.4 | 63.1 |
| 9 | Polymer 9 | 61.5 | 62.9 |
| 10 | Polymer 10 | 65.8 | 64.9 |
| 11 | Polymer 11 | 66.6 | 67.5 |
| 12 | Polymer 12 | 64.9 | 66.4 |
| 13 | Polymer 15 | 61.3 | 64.5 |
| 14 | Polymer 16 | 61.0 | 61.9 |
| 15 | Polymer 17 | 62.8 | 63.2 |
| 16 | Polymer 18 | 60.9 | 62.5 |
| 17 | Polymer 19 | 61.1 | 63.3 |
| 18 | Polymer 20 | 63.8 | 64.2 |
| 19 | Polymer 21 | 62.0 | 64.6 |
| Comparative Examples | | | |
| 1 | | 44.5 | 60.2 |
| 2 | Vac/VP/DEAEA- copolymer as per Ex. 8 of U.S. Pat. No. 4,444,561 | 55.5 | 63.2 |
| 3 | PEO (Mn = 300) | 42.0 | 56.1 |
| 4 | PEO (Mn = 2,200) | 41.8 | 59.6 |
| 5 | PEO (Mn = 3,500) | 44.9 | 60.2 |
| 6 | PEO (Mn = 4,800) | 45.3 | 59.5 |

TABLE 2-continued

| | Addition 0.5% based on test detergent | % reflectance PES | PES/Co |
|---|---|---|---|
| 7 | PEO (Mn = 9,000) | 46.8 | 61.4 |
| 8 | PEO/PPO (90/10) (Mn = 300 g/mol) | 45.8 | 61.1 |
| 9 | PEO (Mn = 9,000) esterified with succinic acid | 46.8 | 59.3 |
| 10 | Dispersed polyvinyl propionate (K value 51.7) | 43.7 | 58.1 |
| 11 | Dispersed polyvinyl acetate (K value 42.0) | 43.7 | 58.1 |
| 12 | Dispersed polymethyl acrylate (K value 63.2) | 40.1 | 56.8 |
| 13 | Polymer 13 | 40.2 | 55.9 |
| 14 | Polymer 14 | 41.6 | 56.7 |

We claim:

1. A detergent comprising surfactants and builders which contains, as an added soil antiredeposition agent, from 0.1 to 5% by weight of a graft polymer which is obtainable by grafting (a) a polyalkylene oxide which has a number average molecular weight of from 300 to 100,000, is based on ethylene oxide, propylene oxide and/or butylene oxide, and is end group capped at at least one end, with (b) at least one vinyl ester derived frp, a saturated monocarboxylic acid containing 1 to 6 carbon atoms and/or a methyl or ethyl ester or acrylic or methacrylic acid in a weight ratio (a):(b) of from 1:0.2 to 1:10.

2. A detergent as claimed in claim 1, wherein the graft polymer added as a soil antiredeposition agent is obtainable by grafting (a) a polyalkylene oxide having a number average molecular weight of from 1,000 to 50,000, polymerized ethylene oxide content of from 40 to 100 mole %, at least one of the terminal hydroxyl groups being etherified by a $C_1$- to $C_{18}$-alkyl ether group, phenyl ether group, benzyl ether group, or being esterified with a $C_1$- to $C_{18}$-carboxylic acid or carboxylic acid anhydride, or being reacted with an isocyanate or with a $C_1$- to $C_{18}$-alkylamine, with (b) at least one vinyl ester derived from a saturated monocarboxylic acid containing 1 to 6 carbon atoms or a methyl or ethyl ester of acrylic or methacrylic acid.

3. A detergent as claimed in claim 1, wherein the graft polymer added as a soil antiredeposition agent is obtainable by grafting.

(a) a polyethylene oxide having a number average molecular weight of from 1,000 to 50,000 and at least one of the terminal hydroxyl groups being etherified by a $C_1$to $C_{18}$-alkyl ether group, phenyl ether group, benzyl ether group, or being esterified with a $C_1$- to $C_{18}$carboxylic acid or carboxylic acid anhydride, or being reacted with an isocyanate or with a $C_1$- to $C_{18}$-alkylamine, with (b) vinyl acetate in a weight ratio (a):(b) of from 1:0.5 to 1:6, and has a K value of from 5 to 200 (determined according to H. Fikentscher in 2% strength by weight solution in dimethylformamide at 25° C.).

4. A detergent as claimed in claim 1, wherein up to 15 mole % of the polymerized ester groups of the graft polymer are hydrolyzed.

5. A detergent comprising as an added antiredeposition agent, from 0.1 to 5% by weight of a graft polymer which is obtainable by grafting (a) a polyalkylene oxide having a number average molecular weight of from 300 to 100,000, based on ethylene oxide, propylene oxide, butylene oxide or their mixtures, at least one of the terminal hydroxyl groups of the polyalkylene oxide being etherified by a $C_1$- to $C_{18}$-alkyl ether group, phenyl ether group, benzyl ether group, or being esterified with a $C_1$- to $C_{18}$-carboxylic acid or carboxylic acid anhydride, or being reacted with an isocyanate or with a $C_1$- to $C_{18}$-alkylamine, with (b) at least one vinyl ester derived from a saturated monocarboxylic acid having 1 to 6 carbon atoms or a methyl or ethyl ester of acrylic or methacrylic acid, in a weight ratio (a):(b) of from 1:0.2 to 1:10.

6. A detergent as claimed in claim 5, wherein the graft polymer added as soil antiredeposition agent is obtainable by grafting (a) a polyethylene oxide having a number average molecular weight of from 1,000 to 50,000, an ethylene oxide content of from 40 to 100 mole %, at least one of the terminal hydroxyl groups of.the polyalkylene oxide being etherified by a $C_1$- to $C_{18}$-alkyl ether group, phenyl ether group, or being esterified with a $C_1$- to $C_{18}$-carboxylic acid anhydride, or being reacted with an isocyanate or with a $C_1$- to $C_{18}$-alkylamine, with (b) at least one vinyl ester derived from a saturated monocarboxylic acid having 1 to 6 carbon atoms or a methyl or ethyl ester of acrylic or methacrylic acid, in a weight ratio (a):(b) of from 1:0.5 to 1:6.

7. A detergent as claimed in claim 5, wherein the graft polymer added as soil antiredeposition agent has a K value of from 5 to 200 (determined according to H. Fikentscher in 2% strength by weight solution in dimethylformamide at 25° C.).

8. A detergent as claimed in claim 5, wherein up to 15% of the ester groups of the graft polymer are hydrolyzed.

9. A process for soil antiredeposition during washing with detergents having a reduced phosphate content of less than 25% by weight of sodium triphosphate, which comprises using as a soil antiredeposition agent a graft polymer which is obtainable by grafting (a) a polyalkylene oxide having a number average molecular weight of from 300 to 100,000, based on ethylene oxide, propylene oxide, butylene oxide or their mixtures, at least one of the terminal hydroxyl groups of the polyalkylene oxide being etherified by a $C_1$- to $C_{18}$-alkyl ether group, phenyl ether group, benzyl ether group or being esterified with a $C_1$- to $C_{18}$-carboxylic acid or carboxylic acid anhydride, or being reacted with an isocyanate or with a $C_1$- to $C_{18}$-alkylamine, with (b) at least one vinyl ester derived from a saturated monocarboxylic acid having 1 to 6 carbon atoms or a methyl or ethyl ester of acrylic or methacrylic acid, in a weight ratio (a):(b) of from 1:0.2 to 1:10.

* * * * *

UNITED STATES PATENT AND TRADEMARK OFFICE

CERTIFICATE OF CORRECTION

PATENT NO. : 4,846,995

DATED : July 11, 1989

INVENTOR(S) : ALEXANDER KUD ET AL

It is certified that error appears in the above-identified patent and that said Letters Patent is hereby corrected as shown below:

Column 9, Claim 1, line 28, change letters "frp," to "from".

Signed and Sealed this

Twenty-ninth Day of May, 1990

*Attest:*

HARRY F. MANBECK, JR.

*Attesting Officer*

*Commissioner of Patents and Trademarks*